United States Patent [19]

Login et al.

[11] 4,245,004

[45] Jan. 13, 1981

[54] ETHOXYLATED POLYTETRAMETHYLENE GLYCOLS AS FIBER LUBRICANTS

[75] Inventors: Robert B. Login, Woodhaven; David D. Newkirk, Trenton, both of Mich.

[73] Assignee: BASF Wyandotte Corporation, Wyandotte, Mich.

[21] Appl. No.: 909,880

[22] Filed: May 26, 1978

[51] Int. Cl.[2] ..... B32B 27/34; B32B 27/36

[52] U.S. Cl. ..... 428/394; 428/361; 428/395; 568/617; 568/623; 252/8.9; 252/52 A; 427/393.1

[58] Field of Search ..... 428/361, 413, 375; 568/617, 623; 252/8.9, 52 A; 427/390 B

[56] References Cited

U.S. PATENT DOCUMENTS

| | | | |
|---|---|---|---|
| 3,194,772 | 7/1965 | Trotz | 528/355 |
| 3,834,935 | 9/1974 | Symm et al. | 428/361 |
| 4,038,296 | 8/1977 | Greif | 260/410.6 |

FOREIGN PATENT DOCUMENTS

| | | | |
|---|---|---|---|
| 2131977 | 1/1977 | Japan . | |
| 854958 | 11/1960 | United Kingdom | 568/617 |

OTHER PUBLICATIONS

Kuwamura et al., Surface Active Copolymers, *J. Amer. Oil Chem. Soc.*, 48, 29 (1971), pp. 29–34.

Grant, *Hackh's Chemical Dictionary*, 4th Ed., McGraw-Hill, N.Y., pp. 669, 118, 668.

*Primary Examiner*—Sam Silverberg

*Assistant Examiner*—Richard Bueker

*Attorney, Agent, or Firm*—Andrew E. Pierce

[57] ABSTRACT

There are disclosed block copolymer lubricants for synthetic textile fibers which are compounds derived from tetramethylene oxide (tetrahydrofuran) and ethylene oxide of the formula:

$$Y\text{-}[(CH_2\text{—}CH_2\text{—}CH_2\text{—}CH_2\text{—}O\text{—})\text{—}(C_2H_4O)\text{—}H]_x$$

wherein Y is the residue formed by the removal of x atoms of active hydrogen from an initiator having a total of not more than 20 carbon atoms and free of elements other than carbon, hydrogen, and oxygen, preferably said initiator is selected from the group consisting of water, alkylene glycols, polyalkylene glycols, alkanols, phenols, and alkyl phenols; x is an integer of 1 to about 5; n is an integer such that the total tetramethylene oxide residue weight, n x, is about 90 to about 10 percent by weight of the total ethylene oxide residue weight; m is an integer such that the ethylene oxide weight, m x, is about 10 to about 90 percent by weight of the total oxyalkylene weight; and the molecular weight of the tetramethylene oxide residue, n x, is about 500 to about 6000. The block copolymer fiber lubricants of the invention are especially useful as lubricants for synthetic fibers such as polyester, polyamide, polyacrylic fibers and mixtures thereof. The fiber lubricants of the invention generally have unexpectedly superior lubricity and oxidation stability in comparison with the ethoxylated polypropylene glycol block copolymer fiber lubricants of the prior art.

5 Claims, No Drawings

ETHOXYLATED POLYTETRAMETHYLENE GLYCOLS AS FIBER LUBRICANTS

BACKGROUND OF THE INVENTION

1. Field of the Invention

This invention relates to the processing of multi-filament and mono-filament synthetic fibers particularly polyester and nylon fibers with fiber lubricants which are applied as spin-finishes subsequent to extrusion of the fibers from the spinneret.

2. Description of the Prior Art

In the production of polyester and polyamide filaments, the addition of a lubricant after extrusion from the spinneret is essential in order to process the emerging filaments into fibers. Since in many instances the filaments are ultimately subjected to a false twist texturing process in which the fibers are stretched after being contacted with a heated metal plate, in addition to the lubricity properties required to avoid breaking the fibers during such processing, relatively high oxidation stability is required in the fiber lubricant. It is known to utilize polyoxyethylene compounds as fiber lubricants as well as heteric polyoxyalkylenes derived from the random polymerization of ethylene oxide or 1,2-propylene oxide. The heteric polyethers obtained by copolymerizing ethylene oxide or propylene oxide with tetrahydrofuran which are disclosed in Japanese Patent Announcement No. 213-1977 have a molar ratio of ethylene oxide or propylene oxide to tetrahydrofuran of between 9/1 to 1/4. Ethoxylated polybutylene glycols are disclosed as fiber lubricants in U.S. Pat. No. 3,834,935, but these polyethers are based on butylene oxides in which the oxygen atom is bonded to each of two contiguous carbon atoms as represented by 1,2- or 2,3-butylene oxide.

Block copolymers of tetrahydrofuran and ethylene oxide are disclosed for use as surfactants by Kuwamura et al in the *Journal of the American Oil Chemists Society* 48, 29 (1971). The uses suggested for these surface active tetrahydrofuran/ethylene oxide block copolymers are in the area of surfactants, emulsifiers and dispersing agents. Use of these copolymers as lubricants for textile fibers is not disclosed or suggested. The physical properties of the block copolymers are described in Kuwamura et al as resembling those of the ethylene oxide/propylene oxide block copolymers having comparable molecular weight of the hydrophobe and ethylene oxide content.

SUMMARY OF THE INVENTION

It is a primary object of this invention to provide lubricated synthetic fibers and a process therefore wherein said fibers comprise synthetic fibers such as polyester, polyamide, and polyacrylic fibers.

According to the invention, unexpectedly valuable fiber lubricants are provided in a polyether obtained by the block copolymerization of polytetramethylene oxide (tetrahydrofuran) with ethylene oxide. The proportion of ethylene oxide contained in the polyether is preferably kept to a minimum while providing the required water dispersibility or solubility of the polyether in order to facilitate the application of the polyether to the fiber; the major proportion of the polyether preferably contains polytetramethylene moieties to obtain improved oxidation resistance as compared with ethoxylated polypropylene glycols of the prior art. The lubricants of the invention are derived from tetramethylene oxide (tetrahydrofuran) and ethylene oxide and have the formula:

$$Y\text{-}[(CH_2—CH_2—CH_2—CH_2—O—)_n—(C_2H_4O)_m—H]_x$$

wherein Y is the residue formed by the removal of x atoms of active hydrogen from an initiator having a total of not more than 20 carbon atoms which is free of elements other than carbon, hydrogen, and oxygen and preferably being selected from the group consisting of alkylene glycols, polyalkylene glycols, alkanols, phenols, and alkyl phenols; x is an integer of 1 to about 5; n is an integer such that the total tetramethylene oxide residue weight, n x, is about 90 to about 10 percent by weight of the total ethylene oxide residue weight; m is an integer such that the ethylene oxide residue weight, m x, is about 10 to 90 percent by weight of the total oxyalkylene weight; and the molecular weight of the tetramethylene oxide residue, n x, is about 500 to about 6000, preferably about 1000 to about 4000.

Not only do the compounds of the invention provide unexpectedly more effective lubrication than 1,2-propylene oxide analogs of the prior art, but these compositions have unexpected and improved heat stability or resistance to oxidation when subjected to the usual temperatures at which such fibers as polyester, polyamide and polyacrylic fibers are textured by drawing, for instance 200°–250° C.

DETAILED DESCRIPTION OF THE INVENTION AND OF THE PREFERRED EMBODIMENTS

As is well known in the prior art polyether compounds of the invention are produced by first reacting an initiator compound designated as Y in the formula above, said initiator having 1 to 5 active hydrogen atoms. By use of the term "active hydrogen atoms" there is meant any compound which gives a positive Zerewitinoff test. The term active hydrogen atoms is well known and clearly understood by those skilled in the art. However, to remove any possible ambiguity in this regard, the term active hydrogen atoms, as used herein and in the appended claims, includes any hydrogen atom fulfilling the following two conditions:

(1) It is sufficiently labile to open the epoxide ring of 1,2-propylene oxide, and (2) It reacts with methyl magnesium iodide to liberate methane in the classical Zerewitinoff reaction (see Niederl and Niederl, Micromethods of Quantitative Organic Analysis, P. 263, John Wiley and Sons, New York city, 1946).

In utilizing the prior art procedures for making block copolymers contained therein for the preparation of the polyethers of the invention, the 1,2-propylene oxide used therein is replaced with tetrahydrofuran. The preferred initiators are those having up to 3 active hydrogen atoms and one to about eight, most preferably three (3) to about eight (8), carbon atoms. Representative examples of such compounds are water, monohydric alcohols such as phenol, cresol, ethyl alcohol, methyl alcohol, polyhydric alcohols such as hydroquinone, ethylene glycol, butylene glycol, diethylene glycol, glycerol or trimethylolpropane. A wide variety of suitable initiators and general procedures for making polyethers are illustrated, for instance, in U.S. Pat. Nos.

2,674,619 and 2,677,700, incorporated herein by reference.

The polyethers of the invention generally contain a total about 10 to about 90 percent by weight of ethylene oxide residue based upon the total oxyalkylene weight, preferably about 15 to about 75 percent by weight; the proportion varying to the extent required to maintain the desired water solubility or water dispersibility of the fiber lubricants of the invention; the proportion also varying depending upon the molecular weight of the hydrophobic polytetramethylene oxide residue. Generally the total polytetramethylene oxide residue weight is about 90 to about 10 percent by weight, based upon the total oxyalkylene weight, preferably about 85 to about 25 percent by weight. Generally the molecular weight of the tetramethylene oxide residue is about 500 to about 6000, preferably about 1000 to about 4000, it being found that generally the polyether lubricants of the invention have less volatility at elevated temperatures as the molecular weight of the tetramethylene oxide is increased to the above upper limit. However, it has been found that tetramethylene oxide based polyethers of the invention, in comparison with those of the prior art prepared with 1,2-propylene oxide as the hydrophobe, require a comparatively smaller proportion of ethylene oxide in the block copolymer to render the polyether water dispersible or water soluble at ambient temperatures. Further details of the preparation of the block copolymers of the invention can be found in the Examples and in Kuwamura et al as cited above, incorporated herein by reference.

The lubricants of the invention can be applied to the synthetic fibers to be lubricated in any convenient manner, for instance as oils upon dilution with a natural or synthetic oil which is a solvent or diluent for the polyethers of the invention, as waxes by passing the fibers over a block of wax, or as dispersions or solutions in water at ambient temperatures. Since only a very small amount of lubricant is necessary (generally about 0.1 percent by weight to about 1 percent by weight of lubricant being required based upon the weight of the fiber) it is generally most convenient to dilute the lubricant by dissolving or dispersing it in water. The lubricant can then be applied by "kiss roll", spray, immersion or other known prior art techniques. Because the polyether lubricants of the invention are unexpectedly stable at the usual temperatures utilized in texturing by drawing synthetic fibers, conventional stabilizers and oxidants are generally not required. However, where additional stability to oxidation is necessary, suitable additives known in the prior art containing phenolic or aromatic amine groups, for instance Bisphenol A or the antioxidant disclosed in U.S. Pat. No. 3,146,272 can be used.

It is believed that the oxidative deterioration of polyoxyalkylene compounds is accompanied by the formation of carbonyl compounds, peroxides and acids and that the manifestation of such deterioration is often a decrease in viscosity and the concordant formation of volatile by-products as indicated by the fuming of the composition at elevated temperature. Thus, the tendency to smoke or fume of polyoxyalkylene textile lubricants upon their use at elevated temperatures such as about 200° C. is commonly utilized as a general indicator of oxidation stability of the compound. Thermogravimetric analysis is also commonly used in the laboratory to evaluate oxidation stability of such products. For instance, the oxidative stability of the polyoxyalkylene products of the invention was evaluated by utilizing a DuPont Model 990 Thermo-Analyzer. In these test procedures, a gas flow rate of 50 milliliters per minute and a rate of heating of 10° C. per minute was utilized.

The molecular weight of the tetrahydrofuran-ethylene oxide polyether block copolymer lubricants of the invention can be calculated from the hydroxyl number in accordance with the formula:

$$\text{Molecular weight} = \frac{56.1 \times 1{,}000 \times \text{number of hydroxyl groups}}{\text{hydroxyl number}}$$

The hydroxyl number of the polyether can be calculated as described in ASTM D-1638.

The following test methods are used in evaluating the lubricity of the fiber lubricants of the instant invention. Lubricity of polyester filament yarn having fiber lubricants of the invention applied thereto is evaluated by applying to a scoured 125-denier, partially-oriented polyester filament producer yarn the desired percentage of lubricant. The lubricant is applied to the yarn utilizing an Atlas Yarn Finish Applicator made by the Precision Machine Development Company in which yarn is passed at a controlled speed through a continually replenished drop of finish solution of specified strength in order to achieve a uniform wetting of the yarn. The solution is metered using a syringe pump. The yarn during treatment is passed from a feeder globule over an adjustable canter roller which functions to space the yarn filaments for passage over a drying drum utilized in conjunction with the application of heat in the application of the fiber lubricant to the yarn. The yarn finally is passed over a winding tube and is subsequently conditioned overnight under controlled conditions of temperature and humidity (65 percent relative humidity and 70° F.) before being tested. Utilizing the fiber lubricant treated yarn, the coefficient of friction (f) is determined using a Rothschild F-Meter in which the yarn is passed over a 0.313 inch diameter satin chrome pin at a contact angle of 180° and at a speed of 50, 100, 150, 200, 250, and, wherever possible, 300 meters per minute. Tensiometers on the Rothschild machine measure the yarn tension before and after it passes over the friction pin so as to insure uniformity of conditions. The input tension is maintained at a value of 12 grams by use of a controlling drum. The coefficient of friction is determined directly from the instrument chart. Test results utilizing the fiber lubricants prepared in the Examples below are shown in the following table.

TABLE I

Lubricity of the Fiber Lubricants of the Invention on 125 Denier Polyester Yarn

| Lubricant (1% by wt on weight of yarn) | Speed (meters/min.) | Coefficient of friction |
|---|---|---|
| Example 1 (control) | 100 | too high to measure |
| | 200 | |
| | 300 | |
| Example 6 | 100 | 0.91 |
| | 200 | 0.95 |
| | 300 | — |
| Example 2 (control) | 100 | too high to measure |
| | 200 | |
| | 300 | |
| Example 7 | 100 | 0.82 |
| | 200 | 0.85 |
| | 300 | 0.95 |
| Example 3 (control) | 100 | 0.93 |
| | 200 | 0.97 |

TABLE I-continued

Lubricity of the Fiber Lubricants of the Invention on 125 Denier Polyester Yarn

| Lubricant (1% by wt on weight of yarn) | Speed (meters/min.) | Coefficient of friction |
|---|---|---|
| | 300 | — |
| Example 8 | 100 | 0.89 |
| | 200 | 0.93 |
| | 300 | 0.97 |
| Example 4 (control) | 100 | 0.90 |
| | 200 | 0.94 |
| | 300 | 0.97 |
| Example 9 | 100 | 0.75 |
| | 200 | 0.82 |
| | 300 | 0.90 |
| Example 5 (control) | 100 | 0.90 |
| | 200 | 0.95 |
| | 300 | — |
| Example 10 | 100 | 0.78 |
| | 200 | 0.83 |
| | 300 | 0.86 |

The following examples illustrate the various aspects of the invention. Where not otherwise specified throughout this specification and claims, temperatures are given in degrees centigrade and parts, percentages, and proportions are by weight.

EXAMPLES 1-5

(Comparative examples, forming no part of this invention)

Examples 1-5 are respectivley commercially available block copolymers of ethylene oxide and 1,2-propylene oxide available under the trademark "PLURONIC"® and designated respectively PLURONIC L-31, PLURONIC L-35, PLURONIC L-38, PLURONIC L-72, and PLURONIC L-77 polyols. These polyols are further characterized below in Table II and compared with the block poly(ethylene oxide) poly(tetrahydrofuran) copolymers of the invention.

EXAMPLE 6

The analog of PLURONIC polyol L-31 was prepared as follows: A commercially available poly(tetrahydrofuran) product sold under the trademark "POLYMEG 1000" by the Quaker Oats Company was added in the amount of 1000 grams in the molten form to an autoclave equipped with temperature, pressure, and vacuum controls. There was then added to the autoclave 1.42% by weight based on the weight of the poly(tetrahydrofuran) of sodium methoxide as catalyst and the mixture stripped to remove volatiles. The autoclave was heated to 135° C., evacuated to less than 10 millimeters of mercury and then pressurized to 34 pounds per square inch with nitrogen. Ethylene oxide was then added in the amount of 100 grams over a period of approximately 30 minutes and the reaction allowed to proceed until a constant pressure was observed. Catalyst was removed by deionization and the mixture was further stripped to remove volatiles. A low-melting solid was obtained having a hydroxyl number of 101.8 with a theoretical of 102.

EXAMPLE 7

The analog of PLURONIC polyol L-35 was prepared as follows: Using the same procedure and reaction conditions as Example 6 but utilizing a charge of 1000 grams of ethylene oxide and 1000 grams of POLYMEG 1000 a product was obtained having a hydroxyl number of 58.2 with 56 as theoretical.

EXAMPLE 8

The analog of PLURONIC polyol L-38 was prepared as follows: Using the same procedure and reaction conditions as Example 6 and a 2000 gram charge of ethylene oxide with a 500 gram charge of POLYMEG 1000, a product was obtained having a hydroxyl number of 24.4 with 22.4 theoretical.

EXAMPLE 9

The analog of PLURONIC polyol L-72 was prepared as follows: Utilizing the same procedure and reaction conditions as shown in Example 6, 750 grams of POLYMEG 2000, a commercially available poly(tetrahydrofuran) having a molecular weight of 2000 sold by the Quaker Oats Company was mixed with 0.67% by weight, based on the weight of the poly(tetrahydrofuran), of sodium methoxide. The mixture was stripped to remove volatiles and then reacted with 250 grams of ethylene oxide following the procedure of Example 6. A product was obtained having a hydroxyl number of 42.4 with 42 as theoretical and a cloud point of 62° C.

EXAMPLE 10

The analog of PLURONIC polyol L-77 was prepared as follows: Utilizing the same procedure as described in Example 9, 1750 grams of ethylene oxide was reacted with 750 grams of POLYMEG 2000. The product obtained had a hydroxyl number of 20 with 17 being theoretical and a cloud point greater than 100° C.

The oxidation stability of the tetrahydrofuran-ethylene oxide based copolymers of the invention was compared by determining the temperature in air at which a 1% weight loss occurs. The results shown below in Table II indicate generally superior performance with respect to oxidation stability for the copolymers of the invention as compared to the prior art ethylene oxide/1,2-propylene oxide copolymers having comparable molecular weight and hydroxyl number.

TABLE II

Fiber Lubricant Oxidation Stability

| Ex. No. | Average Molecular Weight/ Hydrophobe | | Average % by Weight Ethylene Oxide | Hydroxyl # | Temperature in Air at Which 1% Weight Loss Occurs (°C.) | Smoke Point (°C.) |
|---|---|---|---|---|---|---|
| 1 control | 1100 | 1,2-propylene oxide | 10 | 110 | 185 | 168 |
| 2 control | 1900 | 1,2-propylene oxide | 50 | 59 | 198 | 170 |
| 3 control | 5000 | 1,2-propylene oxide | 80 | 24 | 210 | 170 |
| 4 control | 2750 | 1,2-propylene oxide | 20 | 43 | 180 | 167 |
| 5 control | 6600 | 1,2-propylene oxide | 70 | 18 | 201 | 172 |
| 6 | 1190 | tetrahydrofuran | 10 | 102 | 203 | 172 |
| 7 | 2080 | tetrahydrofuran | 50 | 58 | 226 | 167 |
| 8 | 5000 | tetrahydrofuran | 80 | 24 | 202 | 144 |
| 9 | 2840 | tetrahydro- | 20 | 42 | 203 | 156 |

TABLE II-continued

| Fiber Lubricant Oxidation Stability | | | | | | |
|---|---|---|---|---|---|---|
| Ex. No. | Average Molecular Weight/ Hydrophobe | | Average % by Weight Ethylene Oxide | Hydroxyl # | Temperature in Air at Which 1% Weight Loss Occurs (°C.) | Smoke Point (°C.) |
| 10 | 6050 | furan tetrahydrofuran | 70 | 20 | 220 | 176 |

While this invention has been described with reference to certain specific embodiments, it will be recognized by those skilled in the art that many variations are possible without departing from the spirit and scope of the invention and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A lubricated synthetic textile fiber comprising a polyester, polyamide, polyacrylic fiber or mixtures thereof and present on the surface thereof a lubricating amount of a lubricant comprising a block copolymer oxyalkylene compound derived from tetramethylene oxide (tetrahydrofuran) and ethylene oxide of the formula $$Y\text{-}[(CH_2\text{—}CH_2\text{—}CH_2\text{—}CH_2\text{—}O\text{—})_n\text{—}(C_2H_4O)_m\text{—}H]_x$$

wherein Y is the residue formed by the removal of x atoms of active hydrogen from an initiator having a total of not more than 20 carbon atoms and free of elements other than carbon, hydrogen, and oxygen; x is an integer of 1 to about 5; n is an integer such that the total tetramethylene oxide residue weight, n x, is about 90 to about 10 percent by weight of the total oxyalkylene residue weight; m is an integer such that the total ethylene oxide residue weight of the compound, m x, is about 10 to about 90 percent by weight of the total oxyalkylene residue weight; and the molecular weight of the tetramethylene oxide residue, nx, is about 500 to about 6000.

2. The lubricated fiber of claim 1 wherein Y is the residue of a $C_3$–$C_8$ monoalcohol.

3. The lubricated fiber of claim 2 wherein the total tetramethylene oxide residue content is about 85 to about 60 percent by weight and the total ethylene oxide content is about 15 to 40 percent by weight of the total oxyalkylene residue content and said initiator is selected from the group consisting of water, alkylene glycols, polyalkylene glycols, alkanols, phenols, and alkyl phenols.

4. In a process for lubricating synthetic textile fibers with a polyether fiber lubricant, the improvement wherein a lubricant comprising an oxidation stable polyether is applied to said fibers from an aqueous dispersion wherein said polyether is a block copolymer oxyalkylene compound derived from tetramethylene oxide (tetrahydrofuran) and ethylene oxide having the formula:

$$Y\text{-}[(CH_2\text{—}CH_2\text{—}CH_2\text{—}CH_2\text{—}O\text{—})_n\text{—}(C_2H_4O)_m\text{—}H]_x$$

wherein Y is the residue formed by the removal of x atoms of active hydrogen from an initiator having a total of not more than 20 carbon atoms and free of elements other than carbon, hydrogen, and oxygen; x is an integer of 1 to about 5; n is an integer such that the total tetramethylene oxide residue weight, n x, is about 90 to about 10 percent by weight of the total oxyalkylene residue weight; m is an integer such that the ethylene oxide residue weight of the entire compound, m x, is about 10 to about 90 percent by weight of the total oxyalkylene residue weight; and the molecular weight of the tetramethylene oxide residue, nx, is about 500 to about 6000.

5. The process of claim 4 wherein said synthetic fibers are polyester, polyamide, polyacrylic fibers or mixtures thereof and said initiator is selected from the group consisting of water, alkylene glycols, polyalkylene glycols, alkanols, phenols, and alkyl phenols.

* * * * *